United States Patent [19]

Wiley et al.

[11] Patent Number: 5,072,859

[45] Date of Patent: Dec. 17, 1991

[54] BEVERAGE DISPENSING SYSTEM WIHT CLEAR DRINK PURGE AND METHOD

[75] Inventors: Ronald L. Wiley, Marietta, Ga.; Benjamin D. Miller, Chicago, Ill.; Phillip B. Groover, Woodstock, Ga.

[73] Assignee: The Coca-Cola Company, Atlanta, Ga.

[21] Appl. No.: 525,518

[22] Filed: May 18, 1990

Related U.S. Application Data

[63] Continuation-in-part of Ser. No. 316,364, Feb. 27, 1989, Pat. No. 4,967,932.

[51] Int. Cl.[5] ..... B67D 1/08

[52] U.S. Cl. ..... 222/148; 222/129.1; 222/145; 222/1; 239/106

[58] Field of Search ..... 141/90; 239/106; 222/129.1-129.4, 145, 148, 1

[56] References Cited

U.S. PATENT DOCUMENTS

| | | | |
|---|---|---|---|
| 4,218,014 | 8/1980 | Tracy | 239/106 |
| 4,324,494 | 4/1982 | Pryor et al. | 222/148 |
| 4,691,850 | 9/1987 | Kirschmann et al. | 222/148 |
| 4,765,513 | 8/1988 | McMillin et al. | 222/148 |
| 4,901,888 | 2/1990 | Standlick | 222/148 |
| 4,928,854 | 5/1990 | McCann et al. | 222/145 |
| 4,967,932 | 11/1990 | Wiley et al. | 222/1 |

FOREIGN PATENT DOCUMENTS

| | | | |
|---|---|---|---|
| 1184594 | 7/1989 | Japan | 222/148 |
| 1562274 | 3/1980 | United Kingdom | 222/148 |

*Primary Examiner*—Robert P. Olszewski
*Assistant Examiner*—Steve Reiss
*Attorney, Agent, or Firm*—W. Dexter Brooks; Thomas R. Boston

[57] ABSTRACT

An automatic beverage dispenser having a multiflavor automatic beverage dispensing valve (faucet) and including means for preventing color and flavor carry-over from one drink to the next. The automatic dispenser includes an electronic control system with an on-board computer with a microprocessor which, when a drink vend signal is received by the electronic control system, first checks to determine whether a dark or light colored drink was requested, then checks the last vend to determine if it was a light or dark drink. If the drink ordered was a light drink and the previous drink was a dark drink, then the controller looks to see if the cup dispenser position is occupied. If it is occupied, the flush is delayed until it is free when the soda water will flush to cleanse the nozzle. After flushing, the vend is processed.

10 Claims, 16 Drawing Sheets

BEVERAGE DISPENSING SYSTEM WIHT CLEAR DRINK PURGE AND METHOD

CROSS-REFERENCE TO RELATED APPLICATION

This application is a continuation-in-part to application Ser. No. 07/316,364 filed on Feb. 27, 1989, entitled "Postmix Beverage Dispensing System With Warm Water Purging and Method" now U.S. Pat. No. 4,967,932 and assigned to the same assignee as this application.

BACKGROUND OF THE INVENTION

This invention relates to beverage dispensing and in particular to an automatic beverage dispensing system using a multiflavor nozzle which eliminates color and flavor carryover when dispensing a light colored drink after a dark colored drink.

In a multiflavor valve the potential for color and flavor carryover from one drink to the next is possible. The problem is more distinct when a light colored drink follows a dark colored drink.

SUMMARY OF THE INVENTION

An automatic beverage dispenser, such as (but not necessarily) a postmix dispenser, having an automatic, multiflavor beverage dispensing valve including a solenoid controlled water valve and a solenoid controlled syrup valve and an electronic controlled system including an onboard computer with a microprocessor. The present invention provides the improvement of allowing for the flushing of the nozzle and the diffuser area with water (either soda or plain water) to clean the nozzle area of any previous flavor syrup residue. When a drink vend signal is received by the control system, it is first checked to determine whether the drink is a dark or a light colored drink. The next step is to look at the last vend and determine if it was a light or a dark colored drink. If the drink ordered was a light drink and the previous drink was a dark drink, then the controller looks to see if a cup is located in the cup dispense position. If it is, then the flush is delayed until the cup dispense position is free. Once it is free then the water (either the soda water or the plain water) will flush for two seconds to clean the nozzle. After the flushing takes place, then the vend is processed. If the drink ordered was a dark drink and the previous drink was dark or light, then the vend is processed. If the drink ordered was a light and the previous drink was a light drink, then the vend is processed.

It is an object of the present invention to provide a system for overcoming color and flavor carryover when dispensing a light colored drink after a dark colored drink.

It is another object of the present invention to provide an electronic control system in an automatic beverage dispenser having a multiflavor valve with means for checking when a drink signal is received to determine the drink is a dark or a light colored drink, to then determine if a cup is located in the cup dispense position and to determine whether the last vend was a light or a dark colored drink and then to proceed to flush the nozzle and diffuser of the multiflavor dispensing valve if the drink ordered was a light drink and the previous drink was a dark drink.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 1:
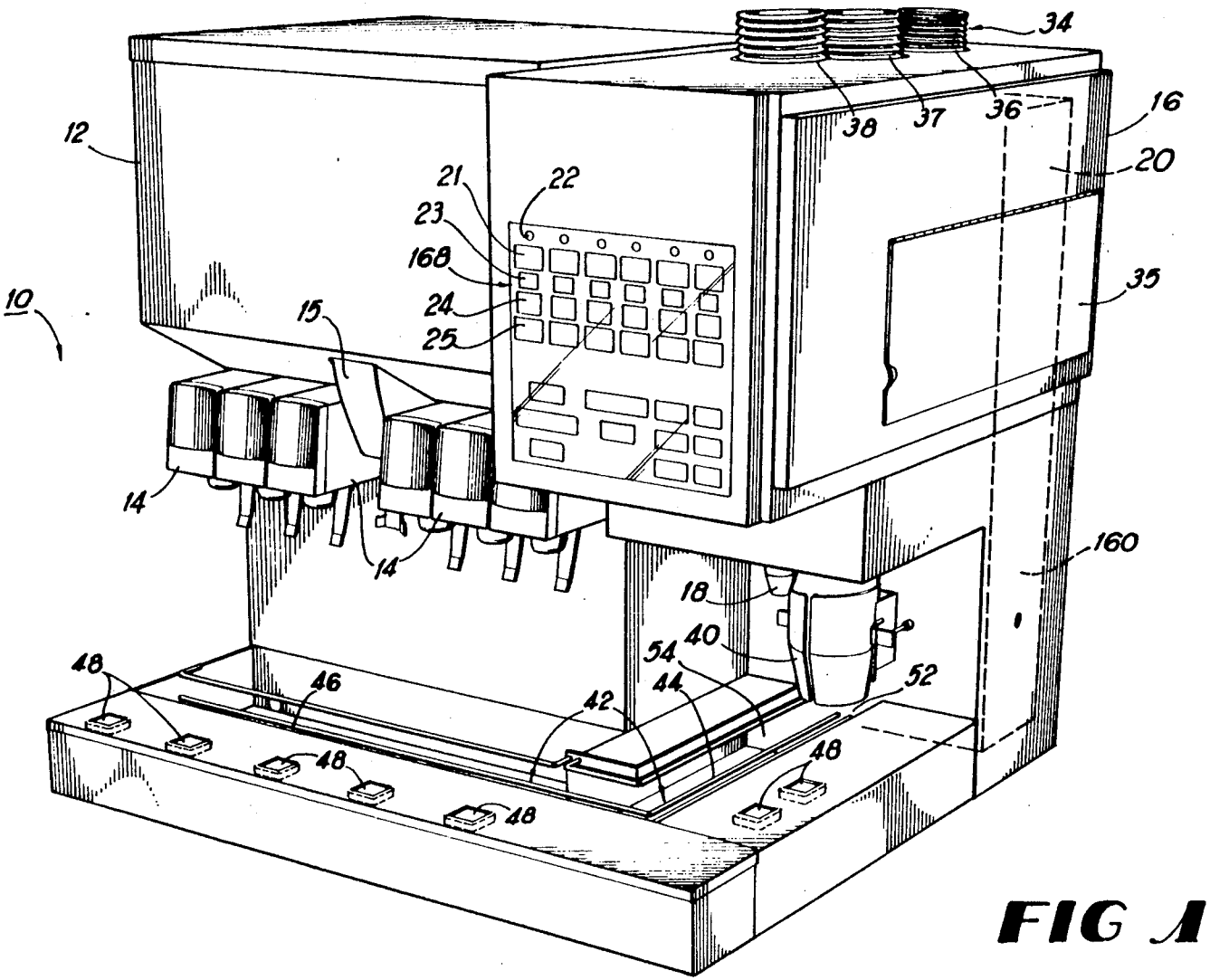
FIG. 1 is a perspective view of an automatic dispenser according to the present invention.
Figure 2:
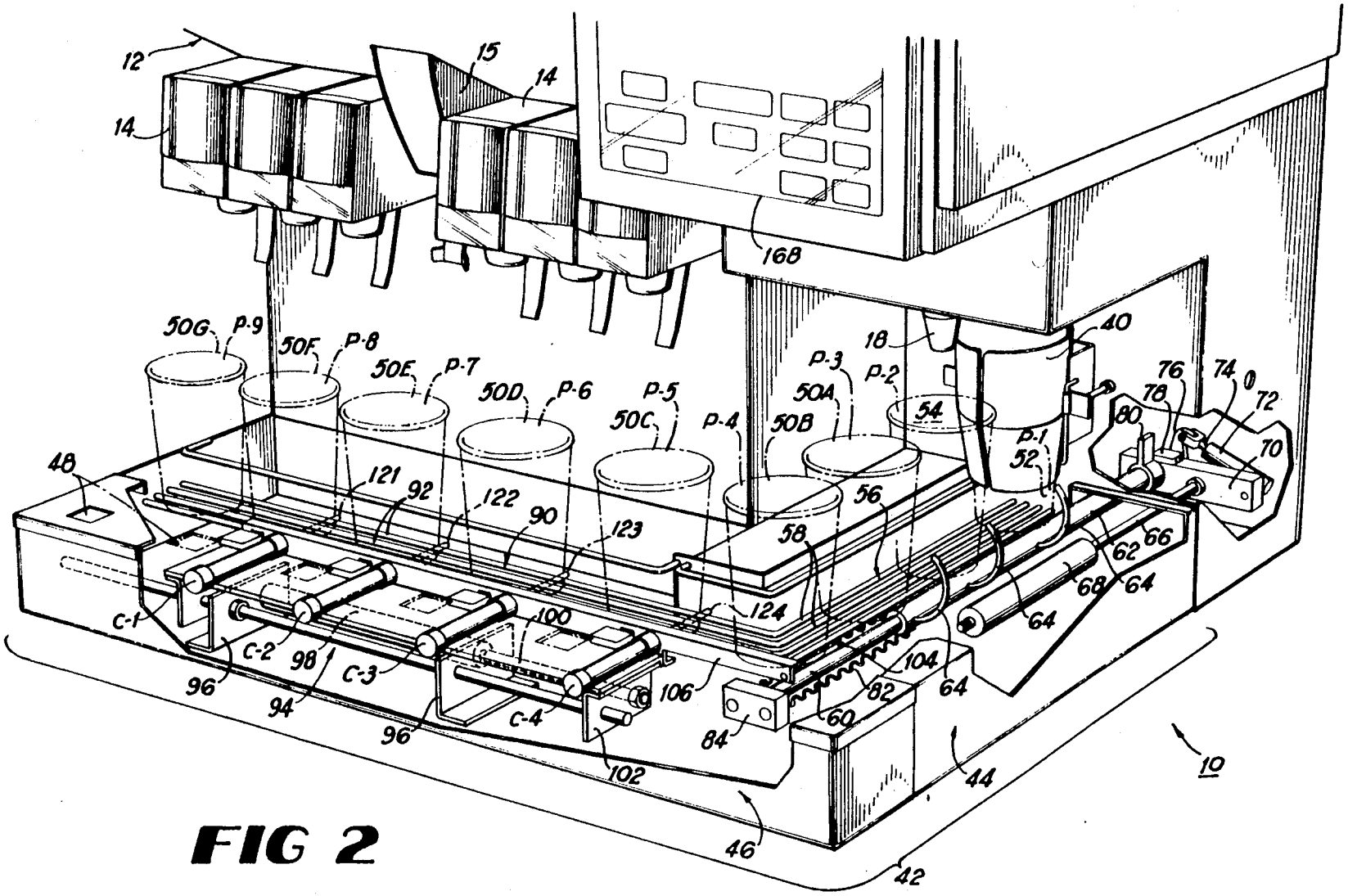
FIG. 2 is a partial, exploded, partly broken-away, perspective view of the dispenser of FIG. 1.

Referring now to the drawings, FIGS. 1 and 2 are perspective views of the automatic postmix beverage dispenser 10 according to the present invention.

The dispenser 10 includes an ice bin module 12 having a plurality of single flavor, manual valves 14 and an ice dispenser 15, and an automatic dispense module 16 having an automatic multiflavor valve 18 (alternatively, two or more multiflavor valves 18 can be located at this position).

The ice bin module 12 includes the usual syrup lines, carbonated water lines, still water line(s), and cold plate for cooling the syrup and water lines leading to the valves 14, which can be any known valves.

The automatic dispense module 16 is attached to the ice bin module, receives ice therefrom, and includes a cabinet 20, a front panel 168 thereon with a plurality of lights and buttons and a door 35 (for access in case of a cup jam). The front panel includes a series of beverage selector buttons 21, a corresponding "syrup out" light 22 above each button 21, and small, medium, and large buttons 23, 24 and 25 respectively below each beverage selector button 21. The front panel may have other buttons and lights as desired for an automatic beverage dispenser.

The automatic dispenser module 16 includes a plurality of syrup lines, a carbonated water line, and a still water line connected to the multiflavor valve 18, which can be any known multiflavor valve. These lines are cooled by the cold plate cooling means in the ice bin module 12. The automatic dispense module 16 also includes a cup drop mechanism 34 (any known mechanism can be used) for three different sizes of cups 36, 37 and 38, a cup drop chute 40, an ice drop mechanism for dropping ice into a dropped cup (any known mechanism can be used), a conveyor 42 including first and second conveyor means 44 and 46, and flavor indicating means including a plurality of flavor indicia 48 located one each adjacent a respective one of a plurality of cup pick-up stations 50 A–G corresponding to cup positions 3–9. The conveyor 42 also provides a cup drop and ice drop station 52 and a beverage dispense station 54. Cup position 1 is the cup and ice drop station 52, and cup position 2 is the beverage dispense station 54.

The first conveyor means 44 moves the cup forward from position 1 to position 4. This first conveyor means 42 includes a cup support surface 56 including several parallel rods 58 and a cup moving means 59. The cup moving means includes a stationary rod 60 and a movable sleeve 62 slidable on rod 60. The sleeve 62 is also accurately movable to rotate a plurality of cup engaging arms 64 into and out of cup engagement. The linear movement of the sleeve 62 is caused by a moveable piston 66 in a stationary cylinder 68. The piston 66 is connected to an arm actuator block 70 which is also connected to the sleeve 62 to move the sleeve 62 one cup position at a time each time the pneumatic piston 66 is energized. To rotate the sleeve 62 and arms 64, an arm rotator cylinder 72 is pivotably attached to the block 70 and its piston 74 is attached to a sleeve arm 76. The block 70 has a proximity switch 78 and the sleeve 62 includes a magnet 80 so the control system will know the position of the arms 64. An elastic boot 82 (shown cut away in FIG. 2) surrounds the rod 60 and extends between the sleeve 62 and a rod support 84.

The second conveyor means 46 includes a cup support surface 90 comprising several parallel rods 92 and the cup moving means 94 includes a stationary support 96 connected to a pneumatic cylinder 98 having a movable piston 100 connected to a movable support 102 holding a plurality of pneumatic cylinders C-1, C-2, C-3, and C-4 each having a retractable cup-engaging pin 121, 122, 123, and 124. In addition, one additional, fixed, cup-engaging pin 104 is connected to a support member 106 mounted on the movable support 102. When it is time to advance certain cups on the surface 90, selected ones of the cylinders C-1, C-2, C-3 and C-4 are energized causing corresponding ones of the pins 121, 122, 123, and 124 to project out to a cup engaging position. The cylinder 98 is then energized to retract the piston 100 one position. The pins 121, 122, 123, and 124 are then retracted and the piston 100 is projected to its original position. Photoeyes 110 are provided at each cup position 1 and 4–9 to determine if a cup is present. If a cup is removed from position 6, for example, pin 123 would not be extended, so that the empty space could be filled in.

Each of the pneumatic cylinders 68, 72, C-1, C-2, C-3, C-4, and 98 in the conveyor 42 are preferably double acting cylinders controlled by solenoids in the gas lines, the solenoids all being preferably located behind the front panel 168.

The conveyor 42 includes a plurality of limit switches for use in controlling the conveyor. For example, the first conveyor means first must rotate to bring the arms 64 into cup engaging position before the pneumatic cylinder 68 moves the conveyor one cup position, then it must rotate back before the cylinder returns the conveyor to its original position. The limit switches determine that all prerequisites have occurred before the next step can be taken.

For example, if a cup is detected at cup positions P-3 and P-4, then the conveyor means 44 can not advance or dispense another beverage. If a cup is removed from position P-7, for example, conveyor 46 will advance the cups at P-6, P-5, and P-4 one position forward to fill the gap, and then conveyor 44 can also move forward one position and can dispense another beverage. There is no photoeye at cup positions P-2 and P-3. The control system can store 16 orders in the dispenser and more can be stored in the point of sale adapter.

The flavor indicating means preferably includes a flavor indicia 48 at each cup pick-up station (positions 3–9) and means for energizing these indicia and for scrolling them every time the conveyor 42 advances cups one position. The term "scrolling" means that the flavor indicia changes to now indicate the flavor in the new cup that has just arrived at that cup pick-up station. Of course, if the next cup has the same flavor as the preceding cup, the new indicia will be the same. In this way, the indicia properly follows a cup along the conveyor until it is removed by an operator at which time the light will go out.

In addition to the flavor indicators 48, a second indicator, such as a lighted display, can be included at each station to indicate the order number of the drink such as 27, for example.

The dispenser 10 also includes a system for eliminating warm casual drinks. This system is shown schematically in FIG. 7.

Figure 6:
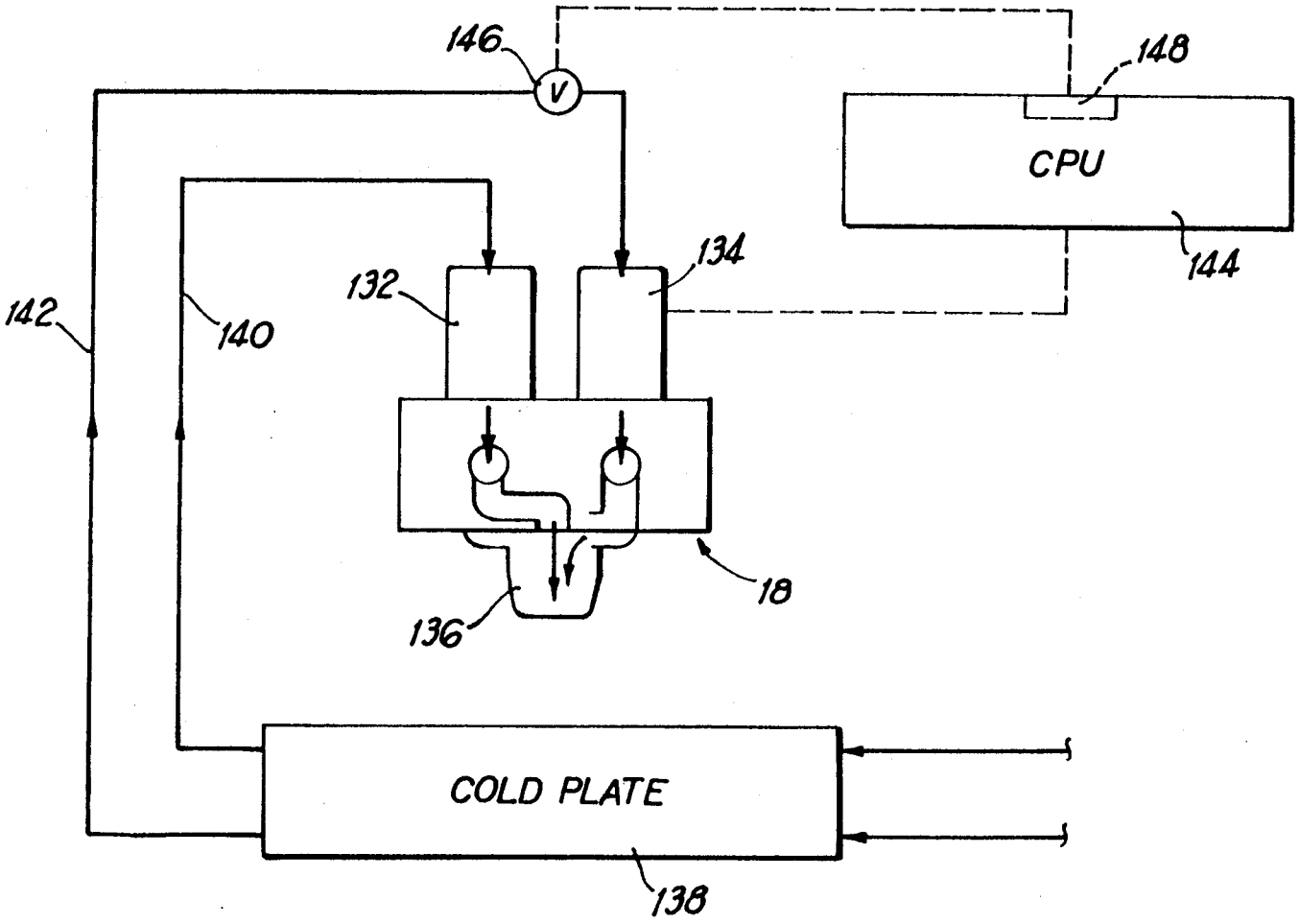
FIG. 6 is a schematic view of a postmix beverage dispenser of the present invention with the means for solving the warm casual drink problem.

FIG. 6 is a partial schematic showing of multiflavor beverage dispensing valve 18, and shows a syrup solenoid valve 132, a water solenoid valve 134, a spout 136, a cold plate 138, a syrup line 140, a water line 142, a CPU 144, and a thermometer 146 in the water line. The CPU includes a timer circuit or clock 148. The CPU is programmed such that when a beverage is requested, it will review how much time has elapsed since the last dispense cycle, and if it exceeds a particular value, such as 15 minutes, a purge cycle will be initialed before the requested beverage can be dispensed. It preferably then opens the water solenoid valve while leaving the syrup solenoid valve closed, for a period of time, such as 5 seconds, to allow the water in the uncooled position of the water line to drain out. The thermometer 146 is not used in the preferred system.

However, in an alternate embodiment, the thermometer 146 is included and when a new drink is requested, if the temperature is above a selected value, such as 40° F., the water is purged until the temperature is reduced to a desired value, such as 38° F. The casual drink purge system of this invention is preferably applied only to the multiflavor valve 18 and not to the manual valves 14, although it could be applied to manual valves, if desired. For example, an inexpensive timer can be used to purge a manual valve for 5 seconds every time 15 minutes elapses since the last dispense cycle.

Figure 3:
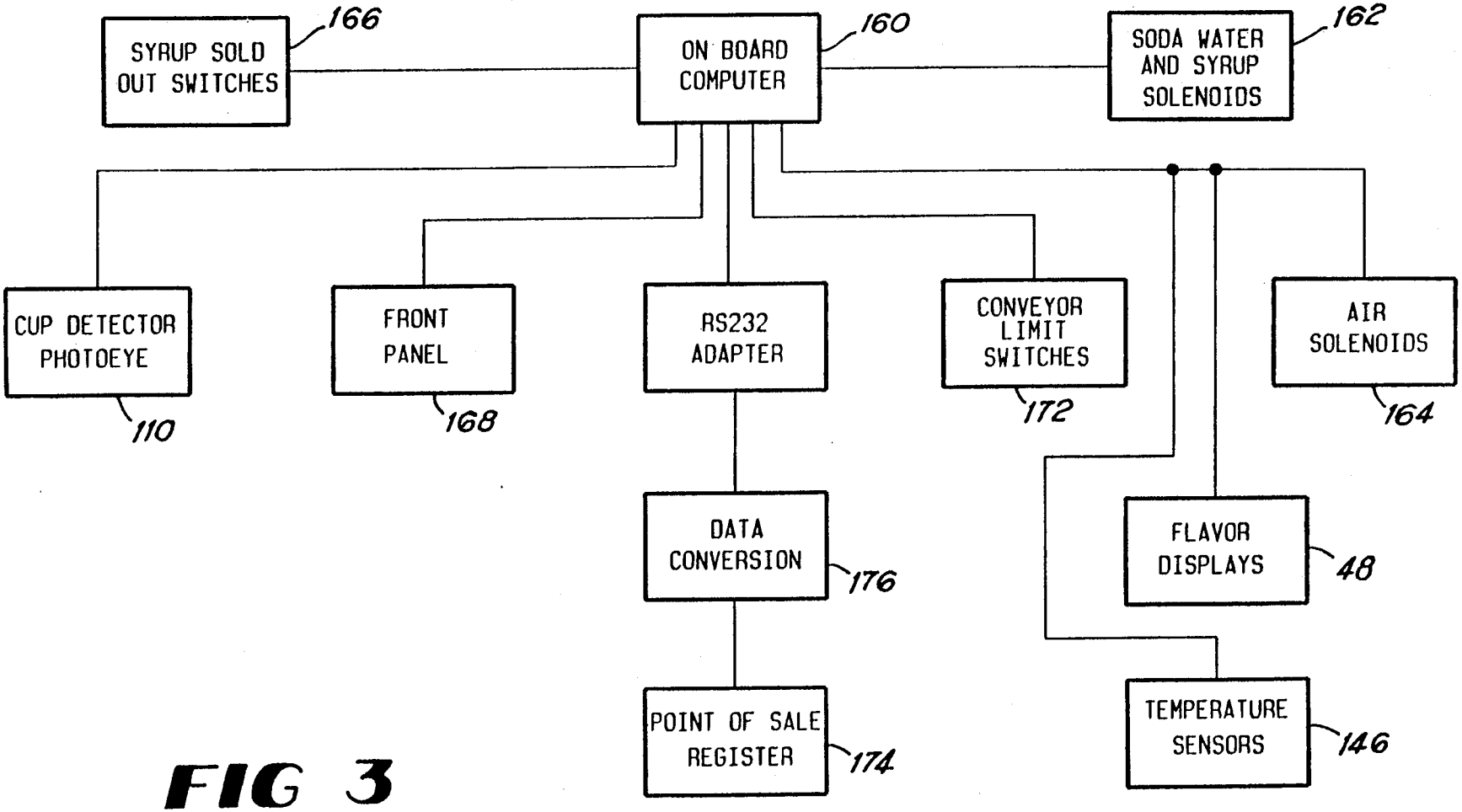
FIG. 3 is a simplified block diagram of the operating system used in the dispenser of FIG. 1.

Returning now to the description of the dispenser 10, FIG. 3 is a simplified block diagram of the system of the present invention. The system includes an on-board computer 160 (which is preferably located in the rear of the automatic dispense module 16, as shown in FIG. 1) connected to all of the water and syrup solenoids 162 in the multiflavor valve 18, the air solenoids 164 in the conveyor 42, the LEDs in the flavor indicia 48, the temperature sensor 146 (in the embodiment in which one is used), syrup sold-out switches 166 connected to corresponding lights on a front panel 168 on the automatic dispense module 16, a keyboard 170 on the front panel 168, conveyor limit switches 172, and a point of sale register 174 which can, if desired, be connected to the computer 160 through a data conversion system 176 and an RS 232 adapter to operate the automatic dispenser 10 directly from the point of sale register 174 on the counter that is used by the operators when taking orders.

Figure 4:
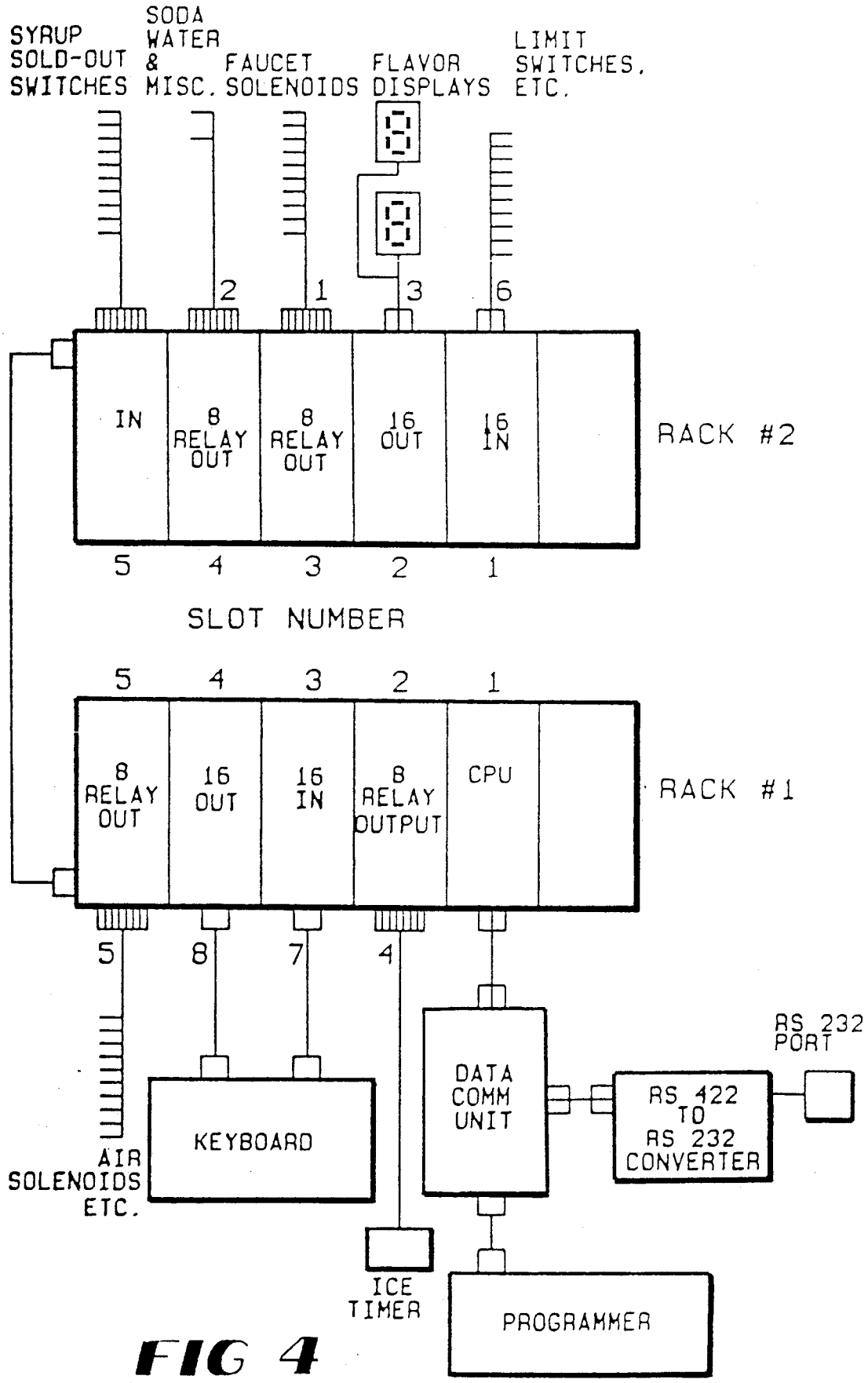
FIGS. 4–4H are block and wiring diagrams for the dispenser of FIG. 1.
Figure 4A:
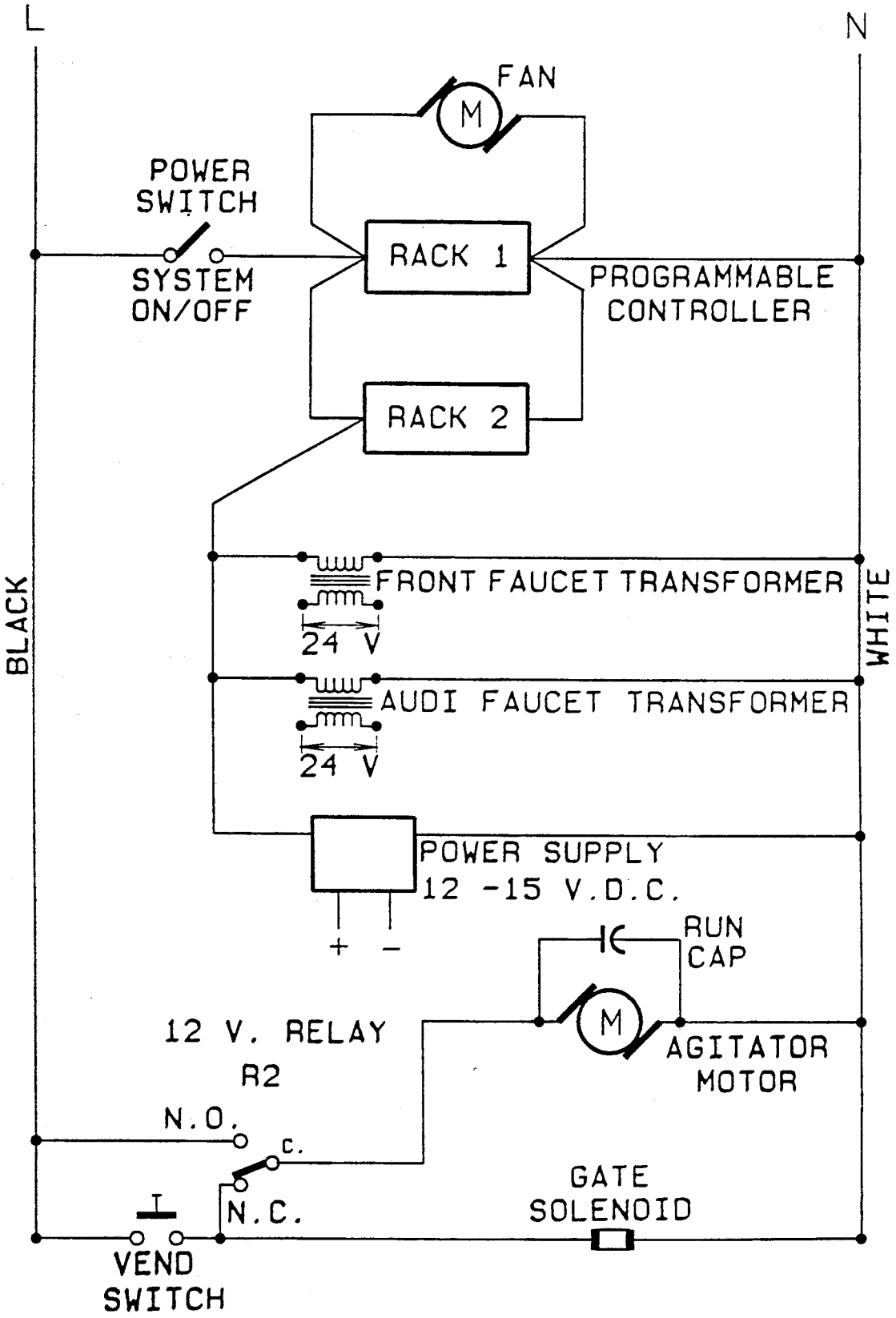
Figure 4B:
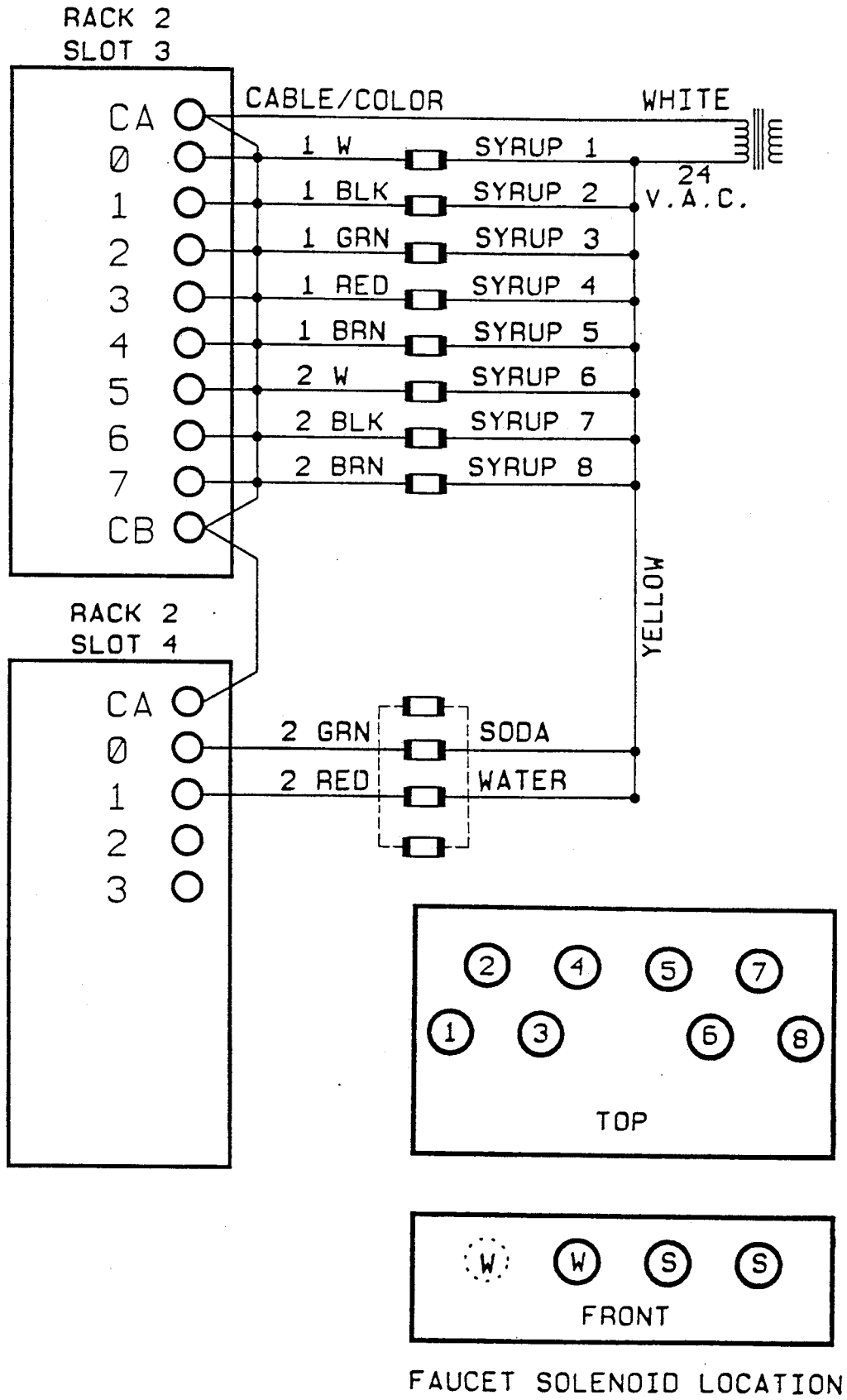
Figure 4C:
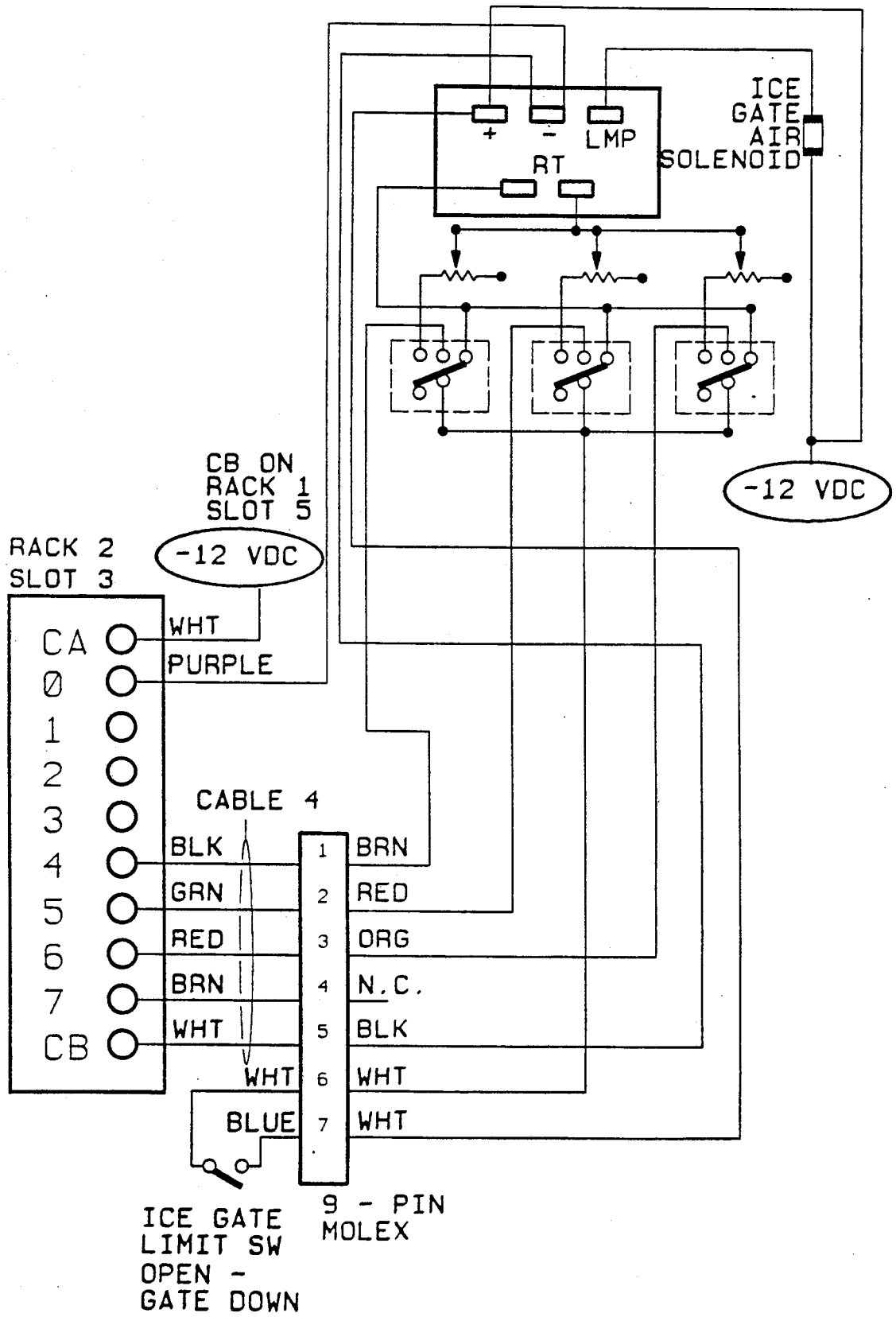
Figure 4D:
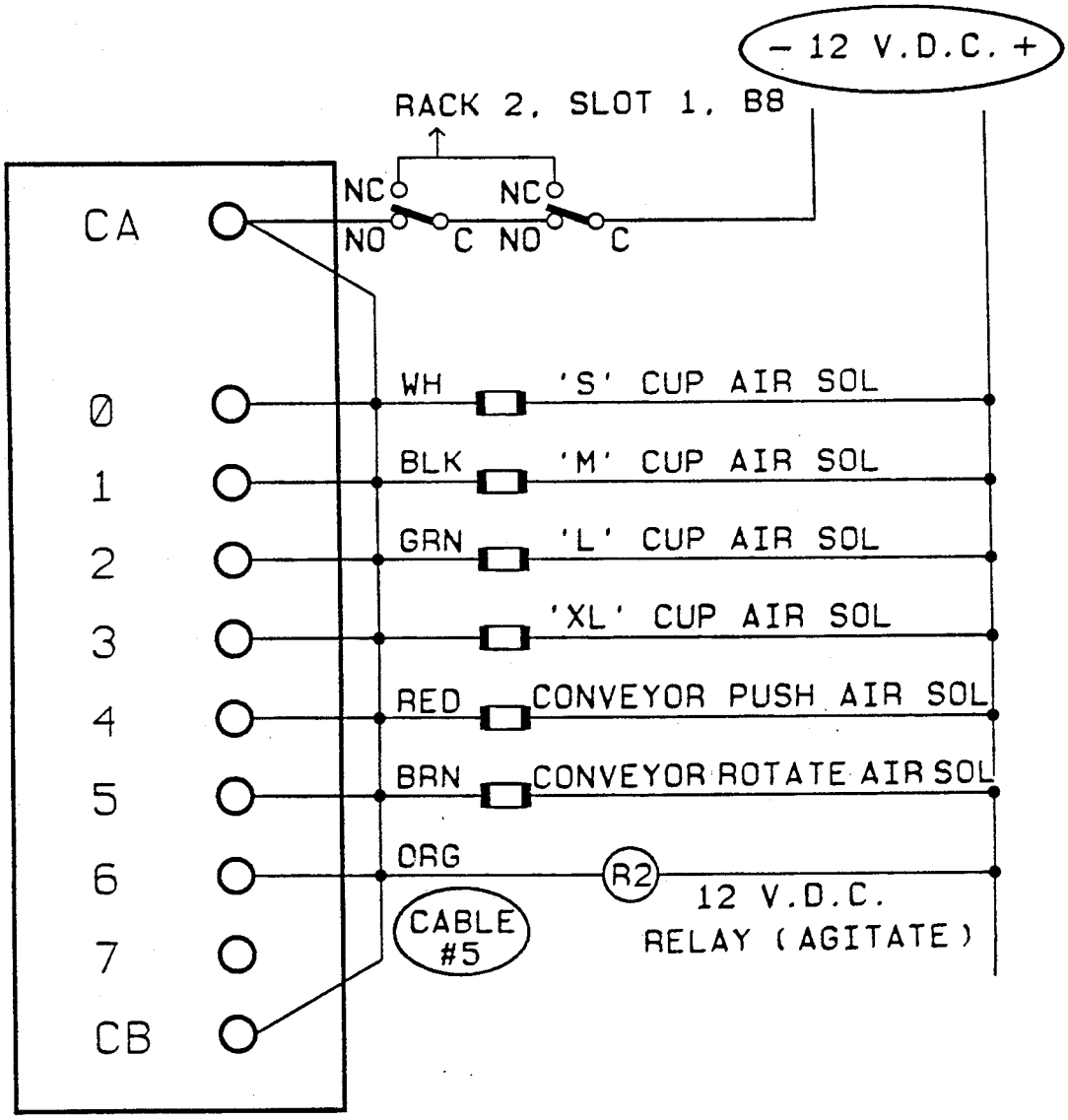
Figure 4E:
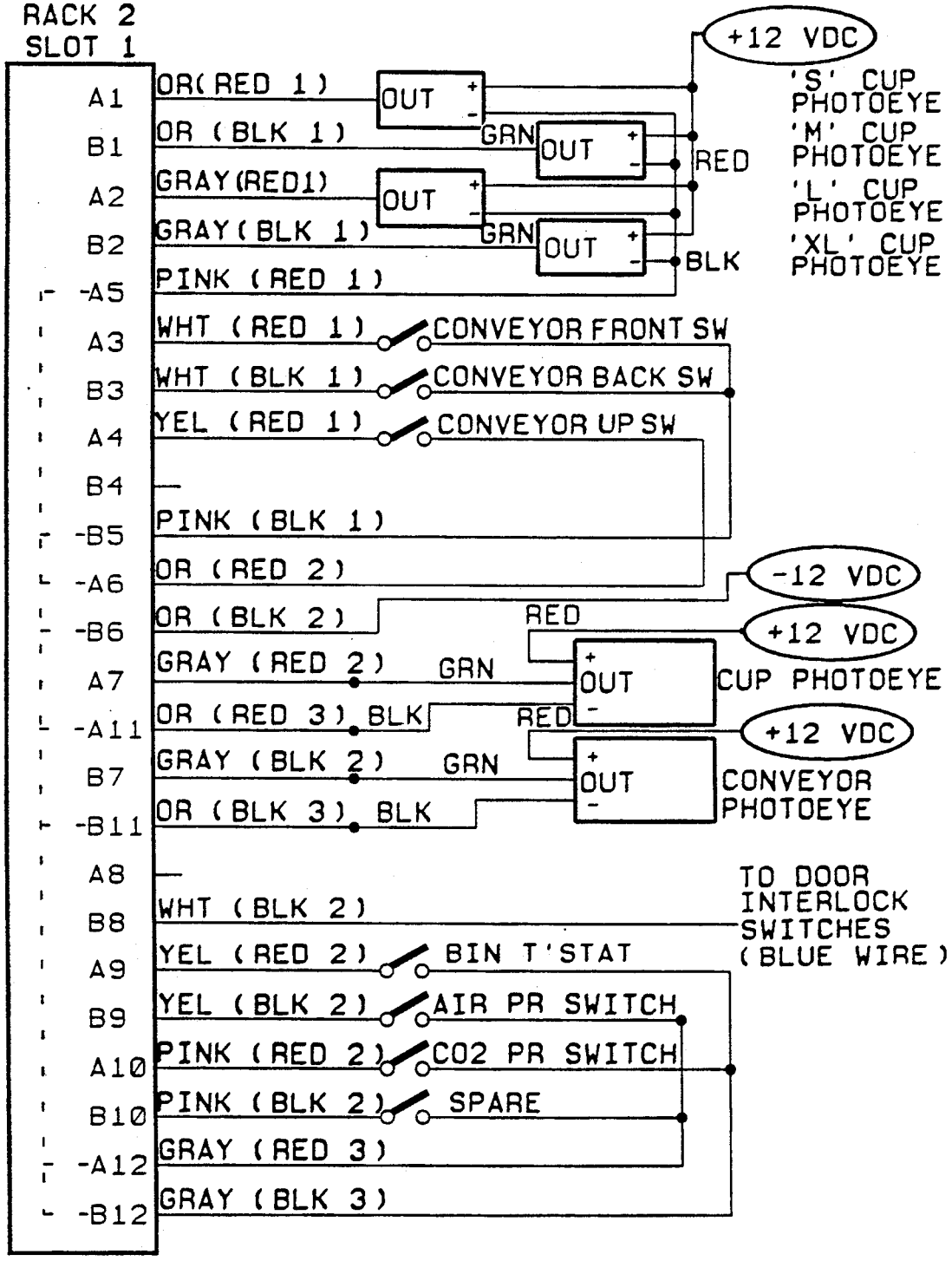
Figure 4F:
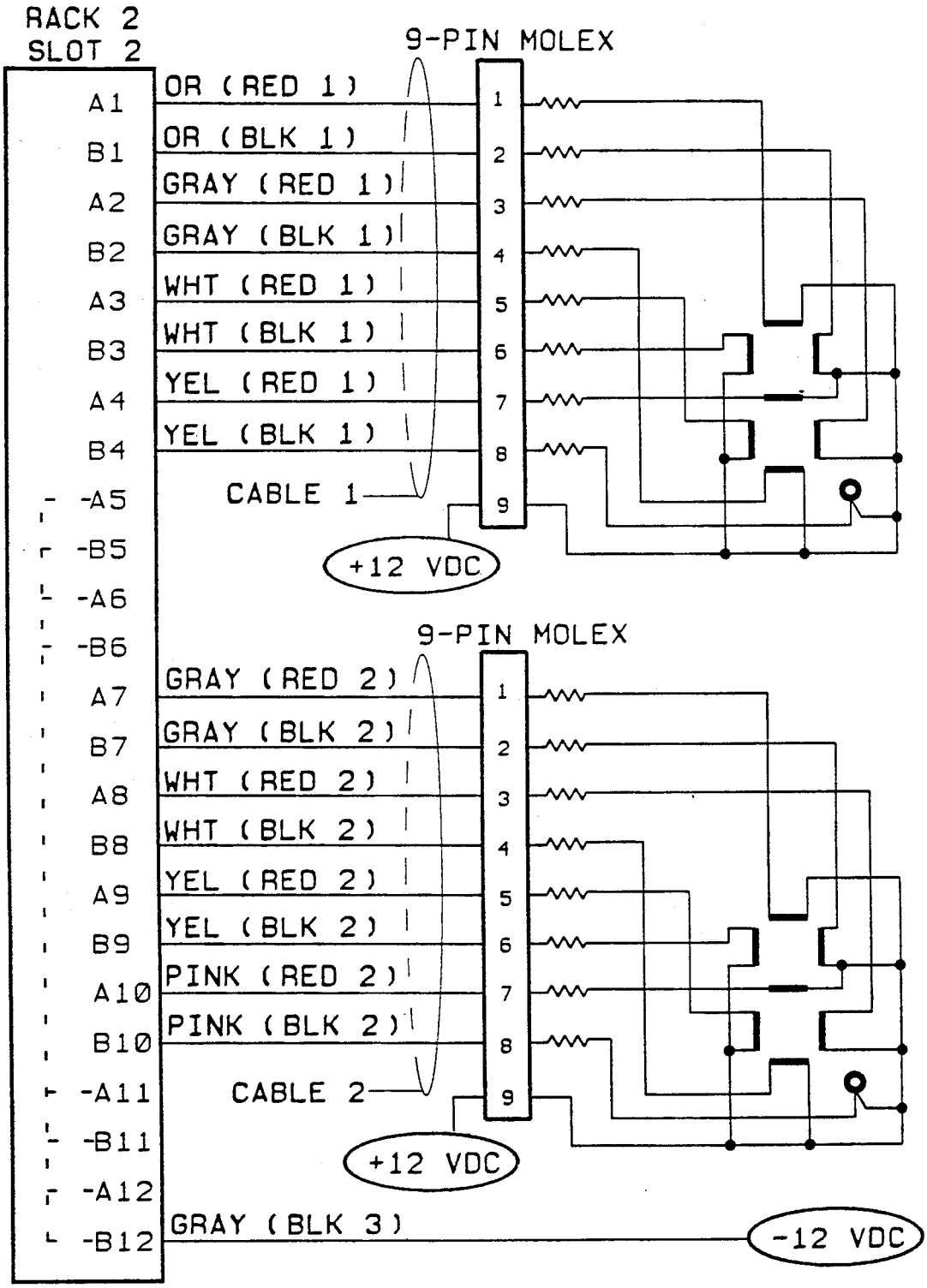
Figure 4G:
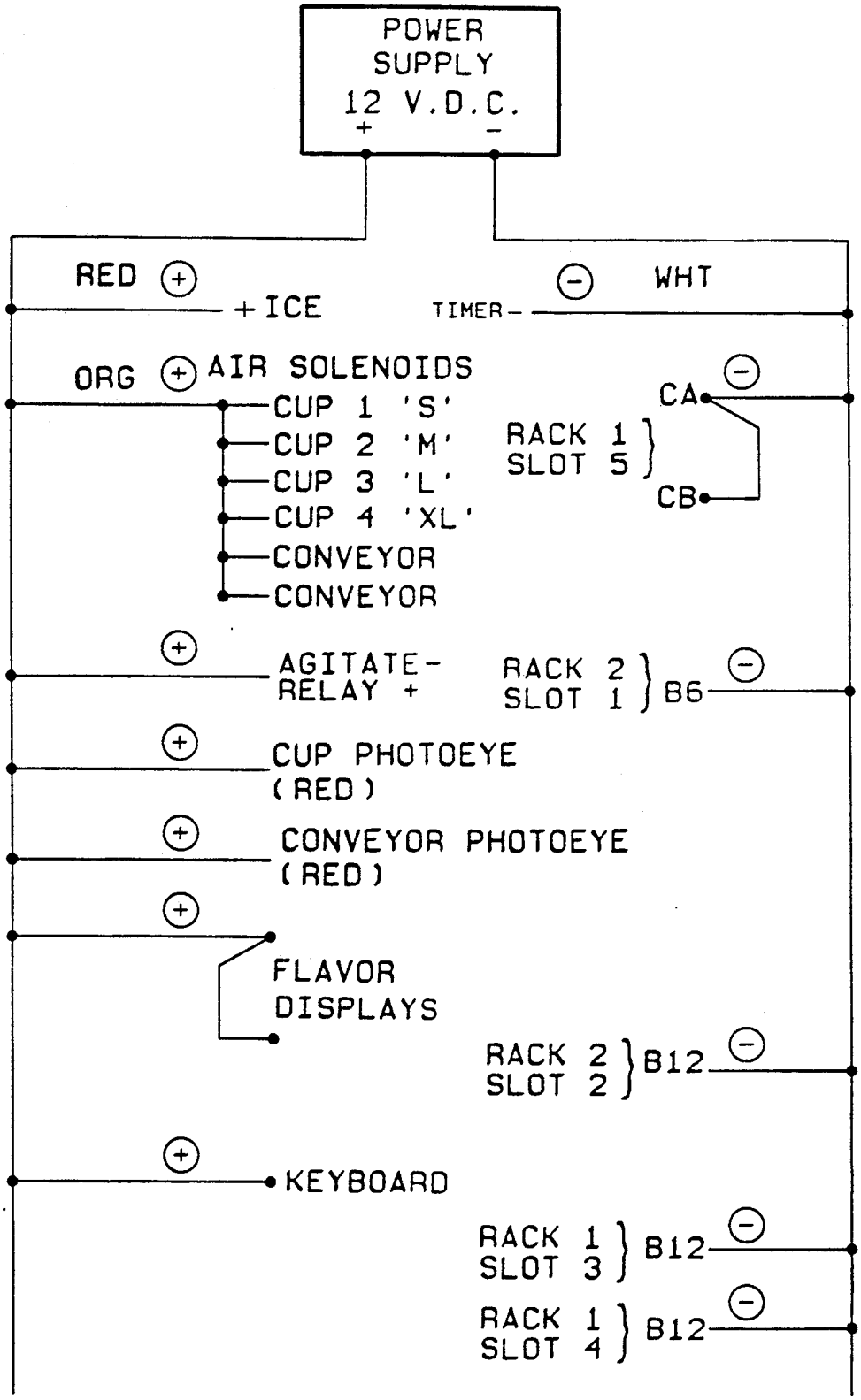
Figure 4H:
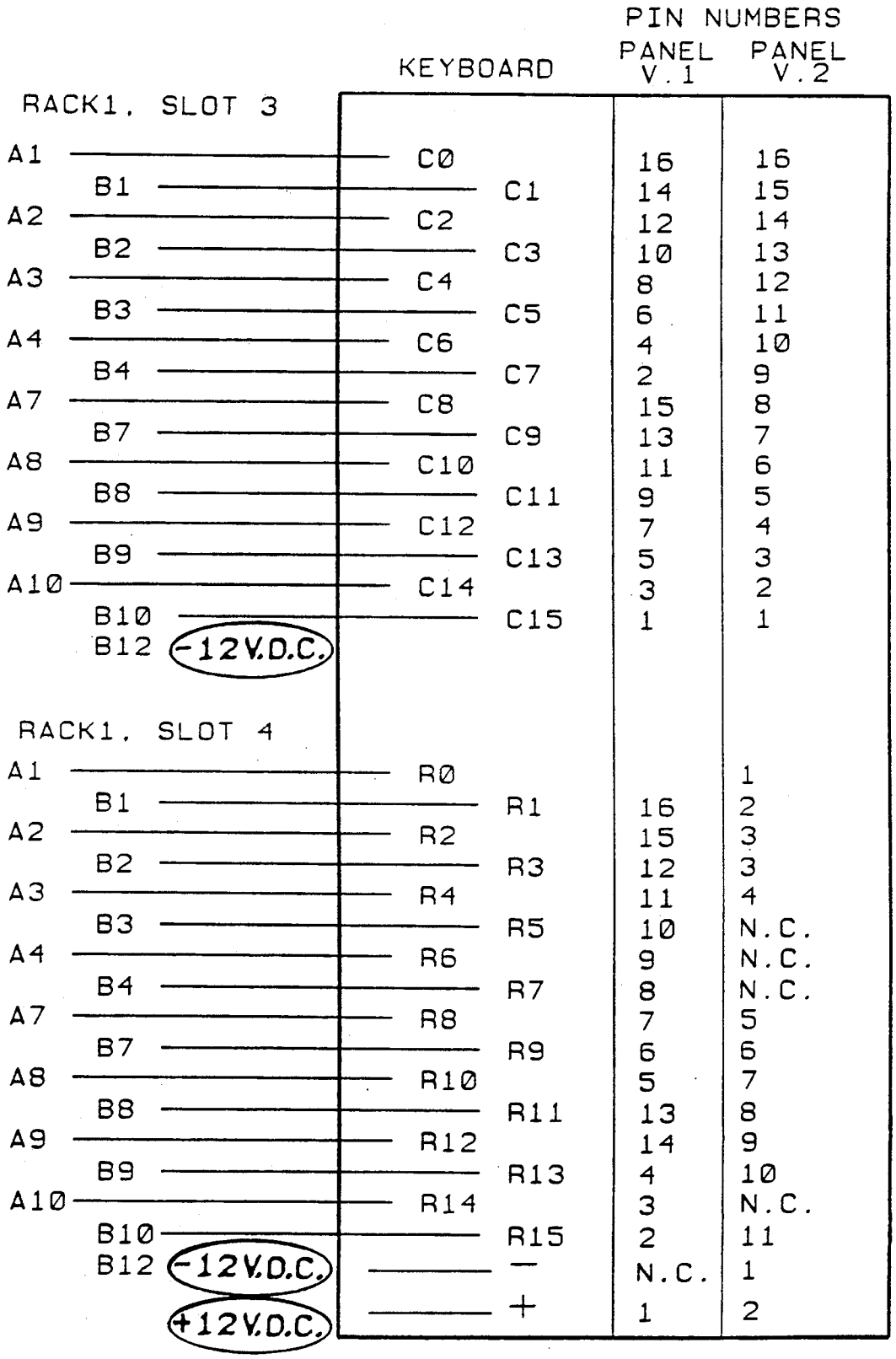

FIGS. 4–4H are the wiring diagrams for connection of external devices to the GE Series One Plus controller used in the preferred embodiment of the automatic dispenser 10 as follows:

FIG. 4 is the control system block diagram,

FIG. 4A is the 120 VAC power distribution wiring,

FIG. 4B is the dispensing valve wiring,

FIG. 4C is the ice gate system wiring,

FIG. 4D is the air solenoid and agitate relay wiring,

FIG. 4E is the input switch wiring (limit switch and photoeye),

FIG. 4F is the flavor display wiring - conveyor positions 3 and 4,

FIG. 4G is the 12 VDC power distribution wiring, and

FIG. 4H is the keyboard matrix input wiring.

Figure 5:
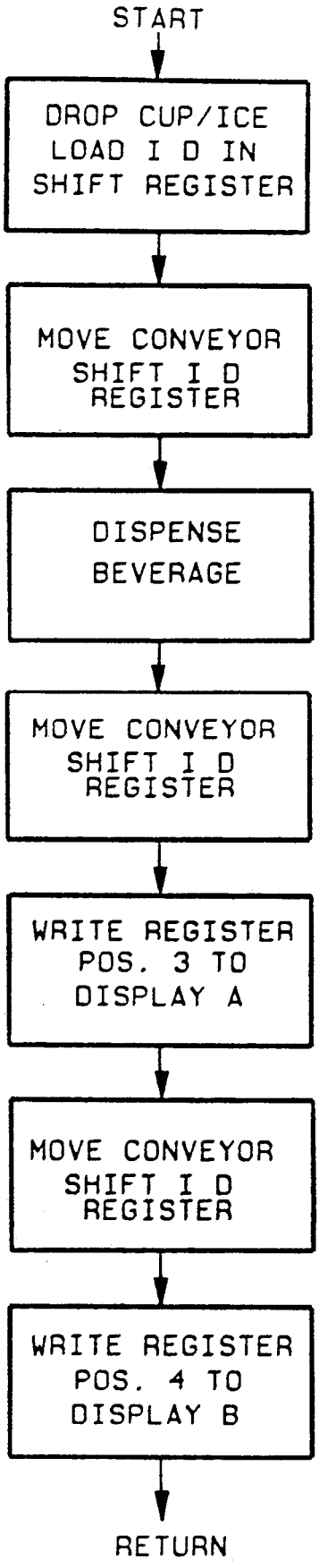
FIG. 5 is a flow diagram of the flavor display operation of the dispenser of FIG. 1.

FIG. 5 is a block flow diagram of the operation of the flavor indicia. The automatic dispenser 10 has the ability to prepare soft drinks from a variety of different flavor selections. It is quite likely that several of the flavors have similar visual appearance in the cup, making it difficult for the operator to distinguish one flavor drink from another. The automatic dispenser 10 solves this problem by employing a display element (flavor indicia 48) at each drink pickup position (cup pick-up station 50A–50G, also known as cup positions P-3 to P-9). In the preferred embodiment, the display is a 7-segment LED with decimal. Each flavor is given a unique code to be shown on the display, for example, "C" of cola, "d" for diet cola, and "0" for orange. These codes are created by assigning each segment of the display to a bit in an 8-bit data word in the controller. The code is created by defining the segments to be turned on, and considering the bit value for the segment to be "1". This binary representation is then converted to decimal for handling purposes in the controller.

The automatic dispenser 10 controller maintains a record of the display codes of drinks dispensed in a shift register format. The shift register is incremented each time the conveyor 42 moves a cup to a new position. The value of the shift register for positions 3 and higher is converted back to binary, and written to an output that is connected to the associated LED display. Therefore, as a cup is moved on the conveyor 43, its display code is shifted to the associated display element. There is a photoeye 110 associated with each conveyor position 4 and higher. Each photoeye 110 detects the presence of a cup, which allows the automatic dispenser 10 controller to shift the conveyor 42 to fill in gaps as cups are removed from the conveyor 42. These photoeyes 110 are also used by the automatic dispenser 10 controller to blank the display at the conveyor position when a cup is removed. If a cup is removed, but no other cup has yet been advanced to that position, the display code may be recalled by placing the cup back on the conveyor momentarily. This is useful if the operator who removed the cup is distracted, and cannot remember the flavor in the cup.

Figure 7:
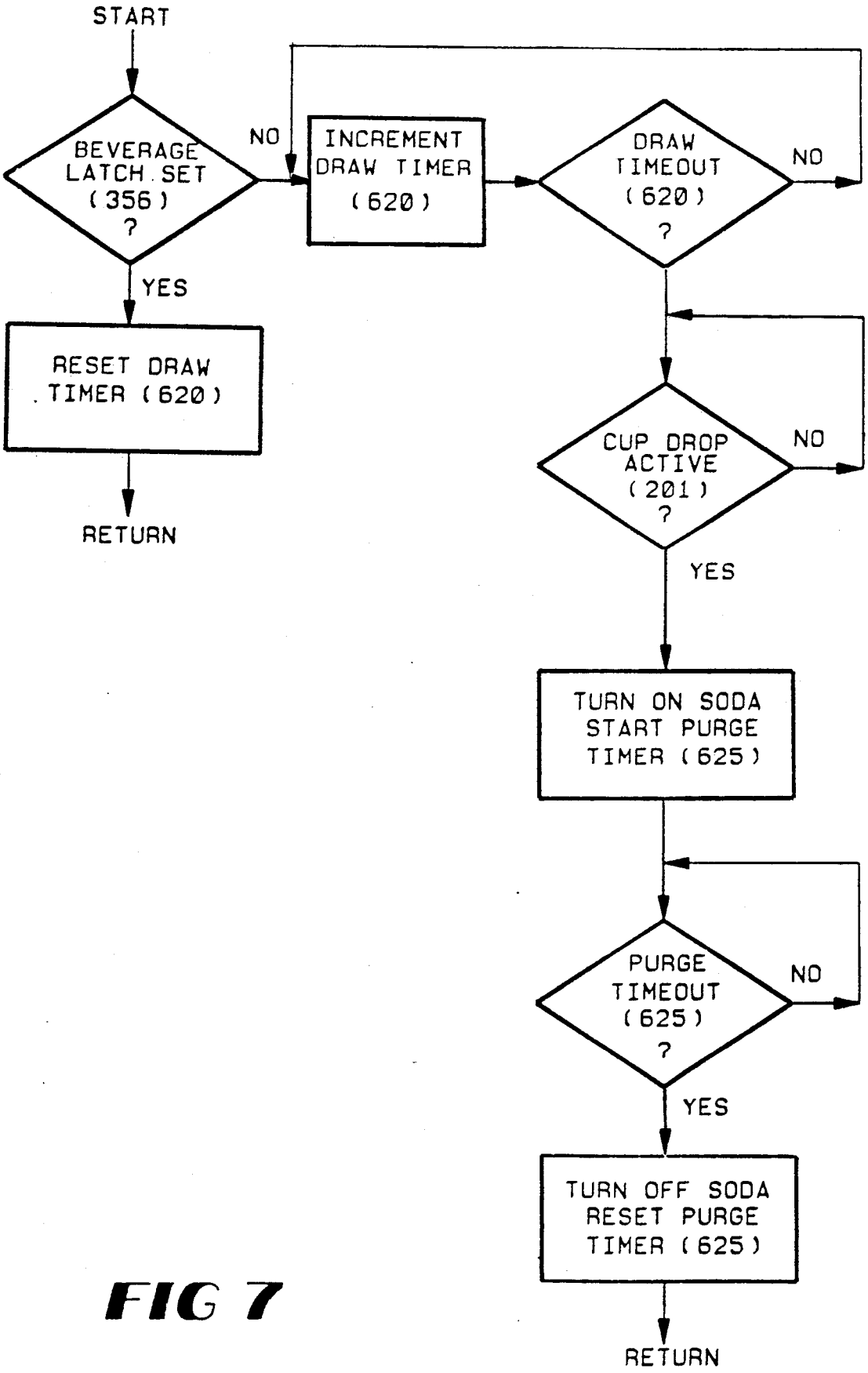
FIG. 7 is a flow diagram of the purge timer logic.

FIG. 7 is a block diagram of the purge timer logic used in the warm water purge system. The purge timer function of the automatic dispenser 10 is intended to provide properly chilled soda water at the automatic dispenser dispensing valve 18 before a drink is poured. This is necessary to insure the quality of the beverage to be poured, as the soda temperature is directly related to the amount of carbonation retained, the amount of foam dispensed, and the amount of ice melted in the cup. This function is controlled by the programmable controller that operates the automatic dispenser 10.

The purge function in the automatic dispenser 10 operates as a pair of timing functions. The Draw Timer is the master element in the process. This timer is reset every time a drink is dispensed from the valve 18 of the automatic dispenser 10. The Draw Timer has a timeout of 15 minutes in the preferred embodiment. When the Draw Timer has reached timeout, the next call to dispense a drink will operate the purge function. In the automatic dispenser 10 this call occurs when a cup has been dropped into the cup drop and ice drop station (also referred to as position 1), and filled with ice, but before the cup is moved to the beverage dispense station (also referred to as position 2) by the conveyor 42. The Purge Timer is used to control the duration of the purge, once it is initiated. In the preferred embodiment, the Purge Timer has a timeout of 5 seconds. The soda solenoid valve 134 in the automatic dispenser 10 valve 18 is opened for the duration of the Purge Time, allowing the purge to be dispensed into the drain of the automatic dispenser. At the completion of the purge, the conveyor 42 is allowed to move the cup to the beverage dispense station (position 2), and normal operation resumes.

Attached hereto as Exhibit A is the ladder logic program listing for the GE Series One Plus controller used in the preferred embodiment of the automatic dispenser 10.

Figure 8:
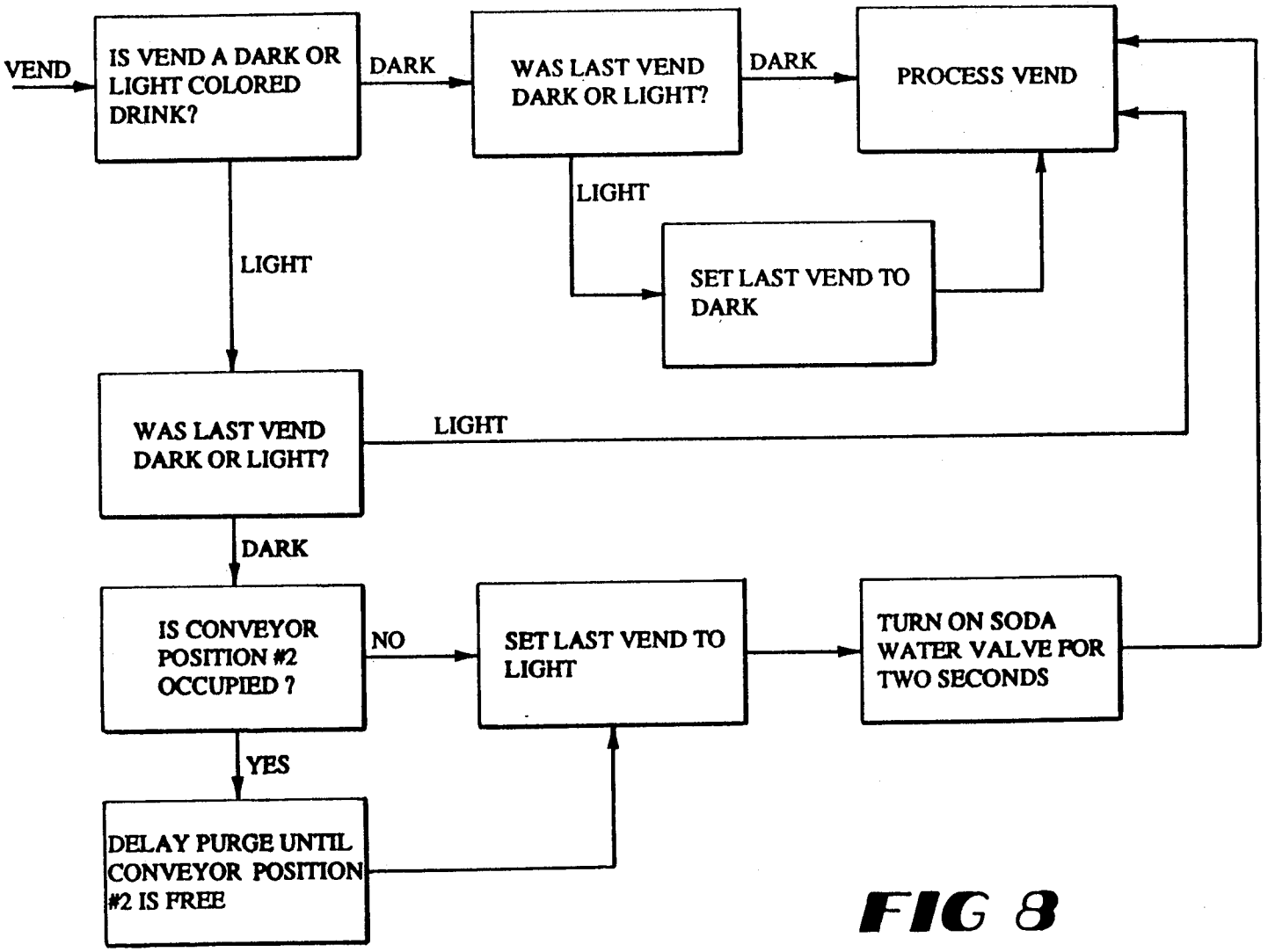
FIG. 8 is a flow diagram of the clear drink purge logic.

FIG. 8 is a block diagram of the clear drink purge logic of the present invention. When a drink vend signal is received by the control system, it is first checked to determine whether the drink is a dark or light colored drink. The next step is to look at the last vend and determine if it was a light or dark colored drink. If the drink ordered was a light drink and the previous drink was a dark drink, then the controller looks to see if the cup dispenser position is occupied. If it is occupied, then the flush is delayed until that position is free. Once it is free, then the soda water will flush for two seconds to cleanse the nozzle. After the flushing takes place, then the vend is processed. If the drink ordered was a dark drink and the previous drink was dark or light, then the vend is processed. If the drink ordered was a light drink and the previous drink was a light drink, then the vend is processed.

While the preferred embodiment of this invention has been described above in detail, it is to be understood that variations and modifications can be made therein without departing from the spirit and scope of the present invention. For example, the flushing can be carried out at any desired time rather than only before a light drink following a dark drink. Plain water can be used in place of soda water for flushing.

What is claimed is:

1. Apparatus comprising:

(a) an automatic beverage dispenser;

(b) said dispenser including an automatic multiflavor beverage dispensing valve including a solenoid controlled water valve and a solenoid controlled syrup valve;

(c) a syrup line in said dispenser connected to said beverage dispensing valve;

(d) a water line in said dispenser connected to said beverage dispensing valve;

(e) flushing means for opening said water valve for a selected period of time while leaving said syrup valve closed to flush the dispensing valve with water to eliminate any previous syrup residue; and (f) said flushing means including means for determining whether the drink to be dispensed is a dark or a light colored drink.

2. The apparatus as recited in claim 1 wherein said flushing means includes means for determining whether the last drink dispensed was a light or a dark colored drink.

3. The apparatus as recited in claim 2 wherein said dispenser includes a cup dispense position located directly beneath said multiflavor dispensing valve and wherein said flushing means includes means for determining if a cup is located at said cup dispense position.

4. The apparatus as recited in claim 3 wherein said flushing means includes means for delaying the flushing if the cup dispense position is occupied by a cup.

5. The apparatus as recited in claim 4 wherein said flushing means includes means for flushing said multiflavor dispensing valve for about two seconds to clean the nozzle.

6. The apparatus as recited in claim 5 wherein said flushing means includes means for dispensing the selected drink when the flushing has been completed.

7. A method for preventing color and flavor carryover from one drink to the next in a multiflavor valve of an automatic beverage dispenser comprising the steps of:

(a) providing an automatic beverage dispenser with a multiflavor beverage dispensing valve including a solenoid controlled water valve and a plurality of solenoid controlled syrup valves;

(b) providing a water line and a plurality of syrup lines in said dispenser to said beverage dispensing valve;

(c) automatically flushing water only through said dispensing valve prior to dispensing a light colored drink following a dark colored drink; and (d) receiving a drink vend signal, then determining whether the drink to be vended is a dark or a light colored drink, then determining whether the last dispensed drink was a light or a dark colored drink.

8. The method as recited in claim 7 including providing said dispenser with a cup dispense position located directly beneath said multiflavor nozzle and including the step of, after a drink vend signal is received by the control system, determining if the cup dispense position is occupied by a cup.

9. The method as recited in claim 8 including the step of delaying the flushing if a cup is located in the cup dispense position.

10. The method as recited in claim 9 including the step of flushing said nozzle for about two seconds if it is determined that the cup dispense position is free and that the drink to be dispensed is a light colored drink and if it is determined that the last drink dispensed was a dark colored drink.

* * * * *